US005593329A

United States Patent [19]

Kato

[11] Patent Number: 5,593,329

[45] Date of Patent: Jan. 14, 1997

[54] WATER INJECTION PROPULSION DEVICE

[75] Inventor: Naoki Kato, Hamamatsu, Japan

[73] Assignee: Sanshin Kogyo Kabushiki Kaisha, Hamamatsu, Japan

[21] Appl. No.: 124,297

[22] Filed: Sep. 20, 1993

[30] Foreign Application Priority Data

Sep. 18, 1992 [JP] Japan ..... 4-273389

[51] Int. Cl.[6] ..... B63H 11/113

[52] U.S. Cl. ..... 440/42; 114/270

[58] Field of Search ..... 114/270, 285, 114/151; 440/40–42, 38; 239/265.35; 60/232

[56] References Cited

U.S. PATENT DOCUMENTS

| | | | |
|---|---|---|---|
| 3,371,642 | 3/1968 | Joy | 114/285 |
| 3,756,185 | 9/1973 | Breslin | 440/42 |
| 4,051,801 | 10/1977 | Woodfill et al. | 440/38 |
| 4,232,626 | 11/1980 | Kern | 114/285 |
| 4,964,821 | 10/1990 | Tafoya | 440/38 |
| 5,045,003 | 9/1991 | Ikeda | 114/270 |

FOREIGN PATENT DOCUMENTS 62205894 7/1986 Japan .

*Primary Examiner*—Edwin L. Swinehart
*Attorney, Agent, or Firm*—Knobbe, Martens, Olson & Bear

[57] ABSTRACT

Two embodiments of jet propelled watercraft having improved electrically powered trim adjustments. In one embodiment, the trim adjustment effects pivotal movement of the discharge nozzle of the jet propulsion unit and in the other embodiment the electric power operates a trim plate of the hull that extends beneath the jet propulsion unit.

4 Claims, 3 Drawing Sheets

WATER INJECTION PROPULSION DEVICE

BACKGROUND OF THE INVENTION

This invention relates to a water jet propulsion device and more particularly to an improved power operated trim adjustment mechanism for a watercraft.

It is well known that the trim of a watercraft is very important in the performance of its propulsion unit. This is particularly true with respect to jet propelled watercraft where the jet propulsion unit discharges water through a discharge nozzle for propulsion of the watercraft. Frequently, the discharge nozzle is also steerable about a vertically extending axis for steering of the watercraft.

The efficiency of the jet propulsion unit will depend to a large extent to the angle of discharge of the water relative to the horizon or horizontal plane. However, as the loading on the watercraft varies, the trim of the watercraft can change and this can adversely affect the efficiency of the propulsion unit.

At times, it may be possible to provide an arrangement wherein the discharge nozzle of the jet propulsion unit is pivotal about a horizontally disposed axis to change the trim angle in response to loading conditions in the watercraft and other factors. In some instances, rather than moving the jet propulsion unit discharge nozzle, a separate trim plate may be employed for the same or a similar purpose. The previously proposed systems have, however, required manual control and hence are not completely satisfactory.

It is, therefore, a principal object to this invention to provide an improved trim adjusting mechanism for a watercraft.

It is a further object to this invention to provide a improved trim adjusting apparatus for a jet propelled watercraft.

It is a further object to this invention to provide a trim adjustment apparatus for a watercraft that is power controlled so as to permit ease of operation and trim adjustment even when traveling at high rates of speed.

SUMMARY OF THE INVENTION

This invention is adapted to be embodied in a jet propelled watercraft having a discharge nozzle configured to discharge water pumped by an impeller for powering an associated watercraft. The watercraft hull also has a portion juxtaposed to discharge nozzle. One of the discharge nozzle and hull portion are pivotal about a generally horizontal axis for adjustment of the trim of the watercraft and power operated means effect the pivotal movement.

DETAILED DESCRIPTION OF THE PREFERRED EMBODIMENTS OF THE INVENTION

Figure 1:
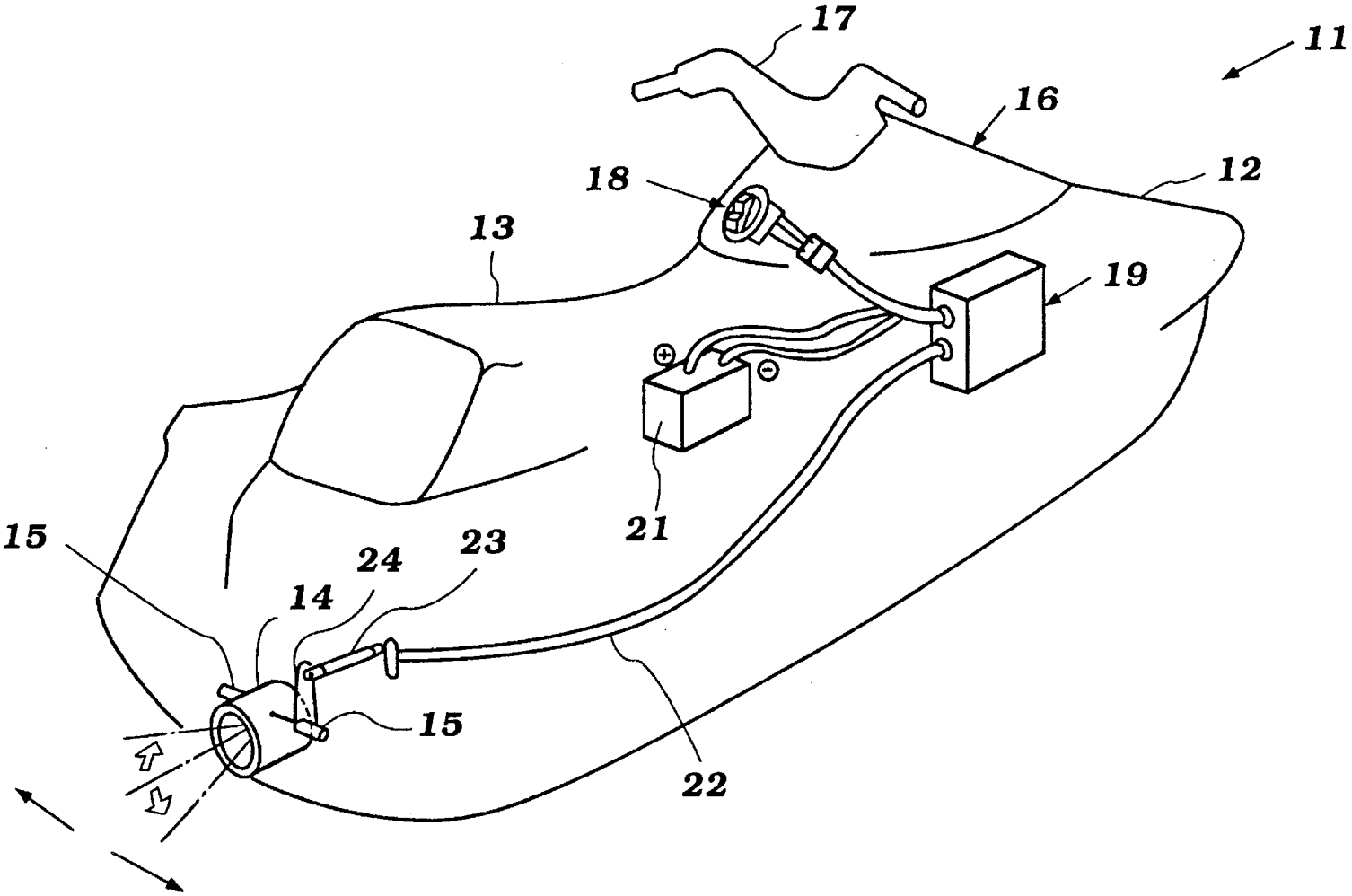
FIG. 1 is a perspective view from the side and the rear, with portions broken away, showing a small watercraft constructed in accordance with a first embodiment of the invention.

Referring first in detail to FIG. 1, a small watercraft constructed in accordance with this embodiment of the invention is shown in perspective and is identified generally by the reference numeral 11. The watercraft 11 is comprised of a hull 12 which may be formed from any suitable material such as a molded fiberglass reinforced resin or the like. The hull 12 defines a rider's area which, in the illustrated embodiment, is comprised of a raised seat 13 having a pair of foot areas (not shown) on its opposite sides which accommodate the feet of one or more riders seated in straddle, tandem fashion on the seat 13.

The area beneath the seat 13 provides a tunnel, which will be described later in conjunction with FIG. 4, which is separated from a forward engine compartment by a vertical bulkhead, which will also be described later. An engine in this forward compartment drives a jet propulsion unit contained within the tunnel and which has a discharge nozzle 14 which, in addition to being supported for steering movement about a vertically extending axis, is supported for trim adjustment about a horizontally disposed axis by a pair of aligned pivot pins 15. Water pumped by the jet propulsion unit will be discharged through the discharge nozzle 14 for propelling the watercraft 11, as is well known in this art.

A control mast, indicated generally by the reference numeral 16, is positioned forwardly of the seat 13 and carries a handle bar assembly 17 which is coupled by means of a bowden wire mechanism (not shown) to the discharge nozzle 14 for its steering in a manner well known in this art. In addition, a throttle control (not shown) may be carried on the handle bar assembly 17 for effecting control of the engine which drives the jet propulsion unit.

The mast 16 also includes a trim control switch, indicated generally by the reference numeral 16, for effecting operation of an electrically operated trim adjusting mechanism 19, having a construction which will be described in more detail by reference to FIG. 2, and which is powered by a battery 21 through an electric circuit shown in FIG. 3 and which will be described by reference thereto. The trim controlling mechanism 19 operates a bowden wire actuator 22 for effecting pivotal movement of the discharge nozzle 14 about the horizontal axis defined by the pivot pins 15. For this purpose, a connector 23 connects the bowden wire actuator 22 to a lever 24 that is affixed to the discharge nozzle 14.

Figure 2:
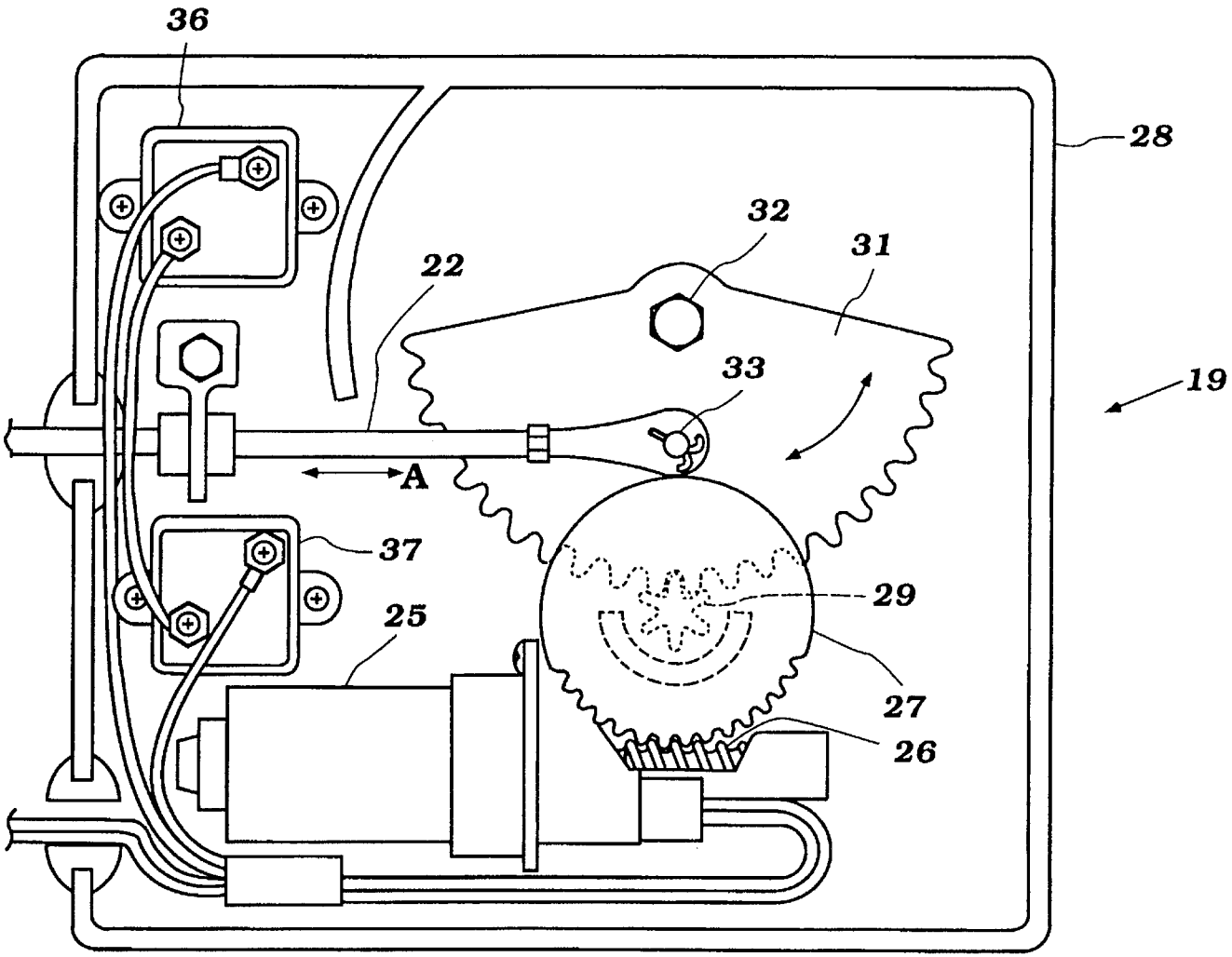
FIG. 2 is an enlarged cross sectional view of the trim adjusting mechanism.

Referring now specifically to FIG. 2, the trim controlling mechanism 19 will be described. This trim controlling mechanism 19 includes a reversible electric motor 25 that has its output shaft drivingly connected to a worm gear 26. The worm gear 26 is, in turn, enmeshed with a worm wheel 27 which is rotatably journalled in an outer housing 28 of the trim adjusting mechanism 19 in any well known manner. The worm wheel 27 has coupled to it a spur gear 29 which is enmeshed with a sector gear 31 which is journalled in the housing 28 on a pivot bolt 32. The bowden wire actuator 22 is pivotally connected to the sector gear 31 by means of a coupling 33. As a result of the aforenoted drive connection between the electric motor 25 and the bowden wire actuator 22, there will be a substantial speed reduction and, at the same time, a multiplication of the force exerted by the electric motor 25 on the discharge nozzle 14 so as to insure its pivotal movement regardless of the force exerted on it and/or the speed at which the watercraft 11 is operating.

The electrical circuit for controlling the electric motor 25 will be described by additional reference to FIG. 3 and certain components of the electrical circuit appear in FIG. 2 and reference to that figure will aid in the understanding of the construction and operation of this construction.

Figure 3:
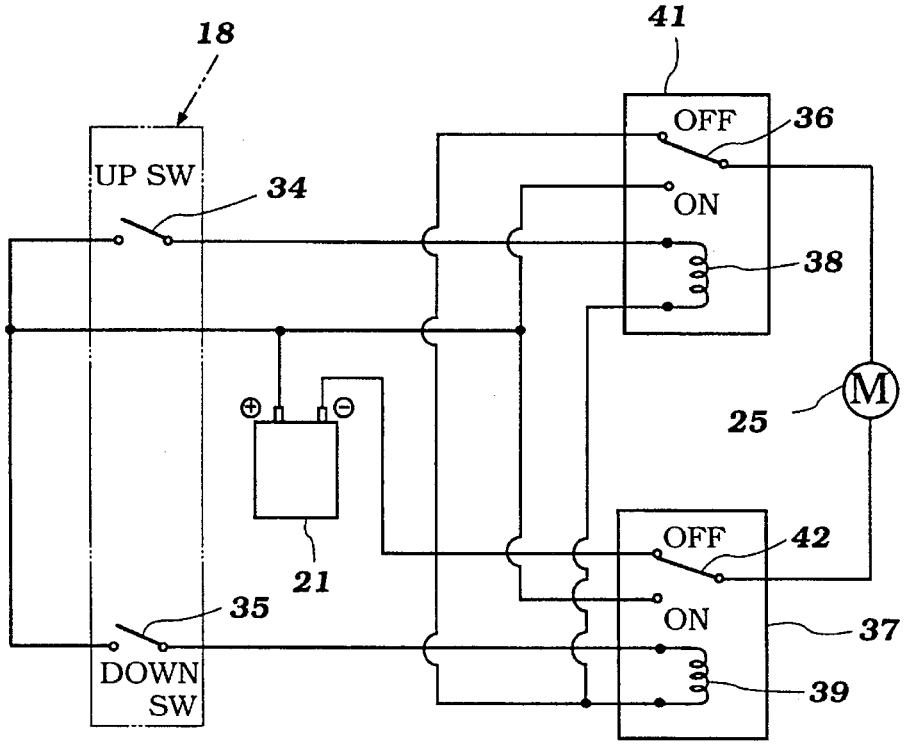
FIG. 3 is an electrical diagram showing the electrical circuitry associated with the trim adjusting mechanism.

The trim control switch 18 may be of any known type and is depicted in the schematic of FIG. 3 has having a trim up switch portion 34 and a trim down switch portion 35. It is to be understood that a single three position switch may be employed but for the purposes of the electrical schematic, two separate two position switches are shown. The switches 34 and 35 are connected to respective relay switches 36 and 37 that have respective solenoid windings 38 and 39 that operate respective contacts 41 and 42. The relay operated switches 36 and 37 are normally opened switches and are shown in this condition in FIG. 3. When so opened, the battery 21 is not in direct circuit with the electric motor 25 and the motor 25 will not be driven. It should be noted that the gearing connection between the motor 25 and the sector gear 31 is such that there will be sufficient mechanical resistance to movement so as to hold the discharge nozzle 14 in its trim adjusted position.

If weight on the watercraft 11 shifts sufficiently so that the rear of it tends to rise in the water, it will be desirable to effect trim-up operation and to do this, the operator moves the trim switch 18 in a direction so as to close the switch 34 and energize the solenoid operated switch 36. This will complete the circuit to the motor 25 so as to drive it in a trim-up direction and cause the nozzle 14 to be trimmed up about the pivot axis defined by the pivot pins 15. When the desired trim adjusted position is reached, the trim switch 18 will be returned to its neutral position.

If, on the other hand, the watercraft 11 is loaded in such a way that the rear of the hull 12 tends to sink relatively to the front of the hull, then the discharge nozzle 14 should be trimmed down so as to provide improved performance. This is done by moving the trim control switch 18 to the position wherein the switch 35 is closed and the relay switch 37 is energized. This will cause the motor 25 to be energized by the battery 21 in a direction to reverse its rotation and effect trim-down operation so as to improve stability and performance.

Figure 4:
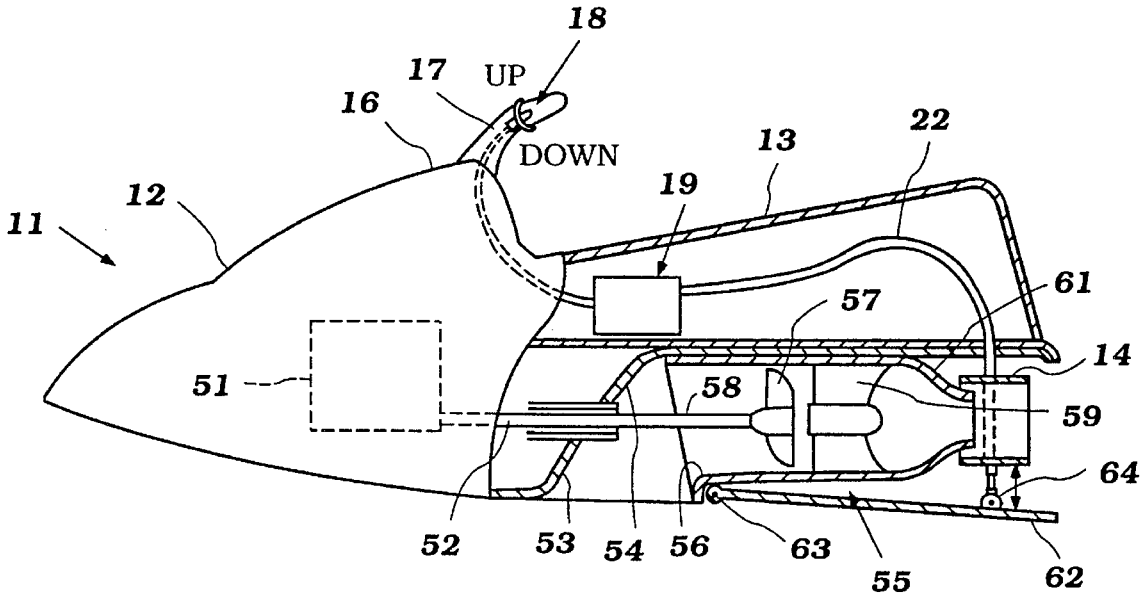
FIG. 4 is a side elevational view, with a portion broken away, of another embodiment of the invention.

FIG. 4 illustrates another embodiment of the invention wherein the trim is controlled by moving a trim plate rather than the discharge nozzle of a jet propulsion unit. There are, however, substantial similarities in the constructions of both embodiments and where that is the case, those components which are the same or substantially the same have been identified by the same reference numerals and will be described again only in so far as is necessary to understand the construction and operation of this embodiment.

As has been previously noted, FIG. 4 shows more details of the actual propulsion unit and that unit will be described first by reference to this figure. An internal combustion engine, shown schematically at 51 is positioned in the forward portion of the hull 12 and drives a driveshaft 52 that extends through a bulkhead 53 which defines the forward end of a tunnel 54 formed in the underside of the hull 12 under the seat 13. A jet propulsion unit, indicated generally by the reference numeral 55, is mounted in the tunnel 54 and has a water inlet opening 56 that is configured to cooperate with the tunnel 54 to form a downwardly facing water inlet into which water is drawn by an impeller 57 that is affixed to an impeller shaft 58. The impeller shaft 58 is coupled to the engine driveshaft 52 in a well known manner and drives the water rearwardly pass straightening vanes 59.

This water then discharges through a discharge nozzle 61 to which the steering discharge nozzle 14, previously described, is pivotally connected for steering movement about a vertically extending steering axis. In this embodiment, the discharge nozzle 14 is not supported for movement about a horizontal pivot axis.

A trim plate 62 extends across the bottom end of the tunnel 54 and underlies the discharge nozzle 14. The trim plate 62 is pivotally connected to the hull by means of a pivot pin 63 for pivotal movement about a horizontally disposed trim axis. The bowden wire cable 22 operated by the trim adjusting mechanism 19, as previously described, is connected to the rear end of the trim plate 62 by a coupling 64 so as to effect trim adjustment of the plate 62 in the manner previously described.

In this embodiment, the trim control switch 18 is mounted directly on the handle bar 17 and, of course, such an arrangement can also be employed when the discharge nozzle 14 is pivoted about a horizontal axis to afford the trim adjustment.

It should be readily apparent from the foregoing description of the described embodiments of the invention are extremely effective in providing rapid and powered trim control for a watercraft so as to maintain optimum propulsion efficiency. Of course, the described embodiments are those are preferred but various changes and modifications may be made without departing from the spirit and scope of the invention, as defined by the appended claims.

I claim:

1. A jet propelled watercraft hull having a discharge nozzle pivotal about a vertically extending steering axis and configured to discharge water at all times when water is pumped by an associated impeller for powering an associated watercraft, a handlebar steering control carried by said hull remotely from said discharge nozzle for pivoting said steering nozzle about said steering axis, said watercraft hull having a portion juxtaposed to said discharge nozzle, said discharge nozzle also being pivotal about a generally horizontal axis for adjusting the trim of said watercraft, and power means comprising a reversible electric drive motor and a transmission for transmitting motion from said reversible electric drive motor to said discharge nozzle for effecting said pivotal movement, said transmission being self-locking at all trim positions of said discharge nozzle so as to preclude pivotal movement under the force of water pressure when said drive motor is not energized, and a control for controlling said drive motor comprised of an electrical switch carried by said handlebar steering control.

2. A jet propelled watercraft hull having a discharge nozzle pivotal about a vertically extending steering axis and configured to discharge water pumped by an impeller for powering the watercraft hull, a steering control carried by said hull remotely from said discharge nozzle for pivoting said steering nozzle about said steering axis, said watercraft hull having a portion juxtaposed to said discharge nozzle, one of said discharge nozzle and said hull portion being pivotal about a generally horizontal axis for adjusting the trim of said watercraft, and power means comprising a removable electric motor and a gear train transmission driven by said electric motor for transmitting motion from said electric motor to said one of said discharge nozzle and said hull portion the effecting said pivotal movement, said gear train transmission being self-locking so as to preclude pivotal movement under the force of water pressure when said electric motor is not energized, and a control for controlling said electric motor juxtaposed to said steering control, said electrical motor being disposed within said watercraft hull at a position spaced substantially forwardly of said discharge nozzle and said hull portion and contiguous to said steering control.

3. The jet propelled watercraft of claim 2, wherein the electric motor and gear train are disposed forwardly of the steering control and are connected to the one of the discharge nozzle and the hull portion by a wire actuator.

4. A jet propelled watercraft hull as set forth in claim 1, wherein the handlebar steering control comprises a pair of spaced apart handlebar portions and wherein the electrical switch is juxtaposed to the outer peripheral end of one of said portions.

* * * * *